United States Patent [19]

Taylor

[11] 4,376,925

[45] Mar. 15, 1983

[54] SWITCH UNITS FOR ELECTRIC IMMERSION HEATERS

[76] Inventor: John C. Taylor, 9 Homefield Park, Ballasalla, Castletown, Isle of Man, England

[21] Appl. No.: 112,797

[22] Filed: Jan. 16, 1980

[51] Int. Cl.[3] ..... H01H 71/16

[52] U.S. Cl. ..... 337/36; 337/53

[58] Field of Search ..... 337/3, 36, 53, 89, 343, 337/365

[56] References Cited

U.S. PATENT DOCUMENTS

| | | | |
|---|---|---|---|
| 2,801,325 | 7/1957 | Pearce | 337/36 X |
| 3,305,655 | 2/1967 | Marcoux | 337/365 |
| 3,569,888 | 3/1971 | Taylor | 337/89 |

FOREIGN PATENT DOCUMENTS

| | | |
|---|---|---|
| 657434 | 9/1951 | United Kingdom . |
| 1392283 | 4/1975 | United Kingdom . |
| 1408388 | 10/1975 | United Kingdom . |
| 1470367 | 4/1977 | United Kingdom . |
| 1542252 | 3/1979 | United Kingdom . |

*Primary Examiner*—George Harris

*Attorney, Agent, or Firm*—Bacon & Thomas

[57] ABSTRACT

A switch unit for an electric immersion heater for mounting on the wall of a liquid heating vessel, the switch unit including thermally responsive means sensitive to boiling liquid on a body of the switch unit in a position for exposure to vapor emerging from the vessel, the thermally responsive means comprising a snap-acting bimetallic actuator. An overcenter spring mechanism couples the bimetallic actuator to a movable contact of an electrical switch for opening and closing the switch, the overcenter spring mechanism being movable between a first position in which the switch is closed and power can be supplied to the immersion heater and a second position in which said switch is open for interrupting the supply of power to the immersion heater. A lever of the overcenter mechanism is pivotally mounted on the body and a spring of the overcenter mechanism is mounted between fulcrums provided by the lever and the body so that the spring biasses the lever into direct or indirect engagement with the bimetallic actuator in the first position of the overcenter mechanism.

7 Claims, 3 Drawing Figures

SWITCH UNITS FOR ELECTRIC IMMERSION HEATERS

This invention relates to switch units for electric immersion heaters for liquid heating vessels, such as kettles, jugs, urns, pans and the like, the switch units including thermally responsive means sensitive to liquid boiling within the vessel.

Such immersion heaters are well known and commonly include a switch unit having thermally responsive means exposed to vapour produced by boiling liquid and coupled by an overcentre lever mechanism to an electrical switch for interrupting the supply of power to the heater. An example of such a switch unit is disclosed and claimed in British Patent Specification No. 1,470,367 which is concerned with the difficulty of ensuring an accurate and reliable operation of the switch, particularly as the geometry of the overcentre mechanism may be faulty due to inaccurately formed parts, or may distort during continued use, so that the mechanism becomes unstable or incapable of operation by the thermally responsive means.

Specification No. 1,470,367 relates generally to a switch unit for an electric immersion heater for mounting on the wall of a liquid heating vessel, the switch unit including thermally responsive means sensitive to boiling liquid on a body of the switch unit in a position for exposure, in use, to vapour emerging from the vessel, an overcentre spring mechanism coupling said thermally responsive means to a movable contact of an electrical switch for opening and closing said switch, said overcentre spring mechanism being movable between a first position in which said switch is closed and power can be supplied to the immersion heater, and a second position in which said switch is open for interrupting the supply of power to the immersion heater, a lever of the overcentre mechanism being pivotally mounted on said body and a spring of the overcentre mechanism being mounted between fulcrums provided by said lever and an abutment on said body so that the spring biasses said lever into engagement with the abutment in the first position of the overcentre mechanism wherein power can be supplied to the immersion heater.

In the overcentre spring mechanism of the unit disclosed in Specification No. 1,470,367, the abutment for the lever is provided in the closed position of the switch in order to position the lever close to the position of unstable equilibrium or dead-centre position and an accurately determined clearance has to be provided between the lever and a thermally responsive bimetallic actuator. This is necessary because of the comparatively limited force and movement which available actuators such as the type described in British Patent Specification 657434 were capable of developing. The power which a bimetallic actuator can provide is dependant on the differential, that is the difference between the temperature at which the bimetal reverses its curvature with increasing temperature and the temperature at which the bimetal reverses its curvature with decreasing temperature. This differential cannot be too large, as this would prevent the bimetal from resetting within an acceptable time, for example 10 seconds. Although the resetting of the bimetal is assisted to a certain extent by the trip lever being manually operated, it still has to snap through the aforesaid clearance between the end of the lever and its cold position when cooling.

Whilst the switch unit disclosed in Specification No. 1,470,367 has been found to operate reliably, nonetheless the measures necessary for this have resulted in the overcentre spring mechanism being rather complicated and expensive.

Recently there has been developed and marketed a bimetallic actuator of the kind disclosed in German Offenlegungsschrift No. 2,556,062 and British Patent No. 1,542,252 and referred to in the catalogue "Kettle controls and element protection" available from Otter Controls Ltd, as used in the Z10 protector.

The actuator comprises a member of sheet bimetal having an aperture with an outer perimeter and an inner perimeter defining a tongue free at one end intermediate two lobe portions of the aperture, the inner perimeter and arcuate portions of the outer perimeter smoothly merging at rounded ends of the aperture adjacent the tongue root, the tongue being, at least in part, generally centrally disposed with respect to the member, the member having been deformed in a die pressing operation to conform in shape to a die of domed configuration, the domed area being such as to reverse its curvature with a snap action with change in temperature and the width of the domed area being greatest in the region of the tongue root.

This actuator is inherently more powerful than the actuator of Specification No. 657,434 and it is the object of this invention to take advantage of the increased power available to simplify and thus reduce the cost of the overcentre lever mechanism of the switch unit disclosed in Specification No. 1,470,367.

Thus, according to the invention, there is provided a switch unit for an electric immersion heater for mounting on the wall of a liquid heating vessel, the switch unit including thermally responsive means sensitive to boiling liquid on a body of the switch unit in a position for exposure, in use, to vapour emerging from the vessel, said thermally responsive means comprising a snap-acting bimetallic actuator comprising a member of sheet bimetal having an aperture with an outer perimeter and an inner perimeter defining a tongue free at one end intermediate two lobe portions of said aperture, said inner perimeter and arcuate portions of said outer perimeter smoothly merging at rounded ends of the aperture adjacent the tongue root, the tongue being, at least in part, generally centrally disposed with respect to the member, the member having been deformed in a die pressing operation to conform in shape to a die of domed configuration, said domed area being such as to reverse its curvature with a snap action with change in temperature, and the width of the domed area being greatest in the region of the tongue root, an overcentre spring mechanism coupling said bimetallic actuator to a movable contact of an electrical switch for opening and closing said switch, said overcentre spring mechanism being movable between a first position in which said switch is closed and power can be supplied to the immersion heater and a second position in which said switch is open for interrupting the supply of power to the immersion heater, a lever of the overcentre mechanism being pivotally mounted on said body and a spring of the overcentre mechanism being mounted between fulcrums provided by said lever and said body so that the spring biasses said lever into direct or indirect engagement with said bimetallic actuator in the first position of the overcentre mechanism.

It will be seen that, according to the invention, the actuator and the lever are in contact in the first position of the overcentre mechanism. This not only avoids the need for accurate spacing of the lever and actuator as in 1,470,367, but also has the result that the resetting of the bimetal when the lever is manually depressed is assisted by virtue of the fact that the lever presses the bimetal through its unstable flat position. Therefore, for the same reset time, the differential of the bimetal can be increased, thus further increasing the force and movement of which the bimetallic actuator is capable. In consequence of the increased power and movement available from the actuator, it has been found to be possible to make the overcentre mechanism less "hair-trigger" by increasing the over dead centre in the first position of the mechanism.

Furthermore, it has now been found that the actuator may actually serve as the stop for the lever in the first position of the overcentre mechanism. There is then a substantial interference between the actuator and the lever to assist in resetting the actuator after it has operated. Thus, pushing the bimetallic actuator right through its dead centre position after it has operated gives the possibility of re-setting the bimetal when it has cooled to its operating temperature with no consideration necessary for the bimetal differential and auto reset.

In the result, the need to ensure dimensional accuracy and stability of the overcentre mechanism has been so reduced that it has been found that it is possible to dispense with the metal fulcrums, pivot and lever insert provided in the preferred embodiment of the overcentre mechanism described in Specification No. 1,470,367 and so to obtain substantial cost savings.

In a preferred feature of the invention, the switch unit comprises a second snap-acting thermally responsive bimetallic actuator comprising a member of sheet bimetal having an aperture with an outer perimeter and an inner perimeter defining a tongue free at one end intermediate two lobe portions of said aperture, said inner perimeter and arcuate portions of said outer perimeter smoothly merging at rounded ends of the aperture adjacent the tongue root, the tongue being, at least in part, generally centrally disposed with respect to the member, the member having been deformed in a die pressing operation to conform in shape to a die of domed configuration, said domed area being such as to reverse its curvature with a snap action with change in temperature, and the width of the domed area being greatest in the region of the tongue root, mounted on the body of the switch unit so as in use to make direct thermal contact with a head plate of a heater unit, means coupling said second actuator to said movable contact and to said over-centre mechanism whereby operation of said second actuator to open said switch also moves said overcentre mechanism to said second position thus maintaining said switch open, the arrangement however, being such that movement of said overcentre mechanism to its first position is ineffective to close said switch whilst said second actuator remains operated.

In a preferred arrangement the movable contact of the switch is mounted on a resilient strip, which strip when displaced by operation of said second actuator moves said overcentre mechanism to said second position, but when said overcentre mechanism is moved to said first position, said second actuator holds said contacts open in its hot position.

In a further preferred feature of the invention, the body of the switch unit provides a barrier for vapour between said first actuator and said electrical switch and said lever extends through an aperture in said barrier, the unit comprising a cover member partially surrounding the position of said lever on the same side of said barrier as said first actuator so as to reduce penetration of vapour through said aperture.

In a preferred arrangement, the lever is a bell crank lever which engages the actuator directly in the first position of the overcentre mechanism. Alternatively indirect engagement is possible as, for example, via a push rod extending through an aperture in the body of the switch unit for transmitting the movement of the actuator to the overcentre mechanism. The push rod engages the actuator in the first position of the overcentre mechanism thus affording the advantages set out above.

Figure 1:
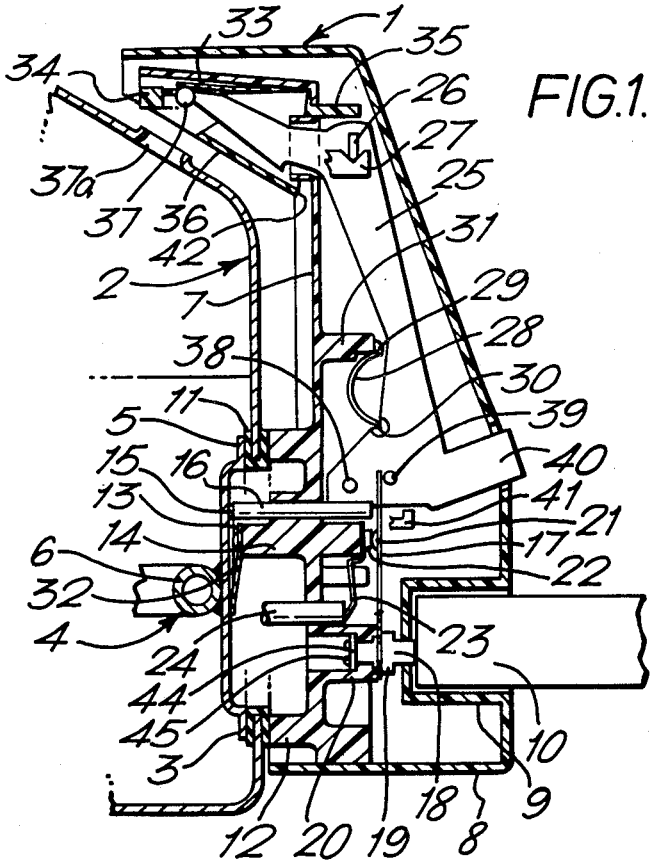
FIG. 1 is a side elevation of a preferred embodiment of the switch unit in the switch closed position.
Figure 2:
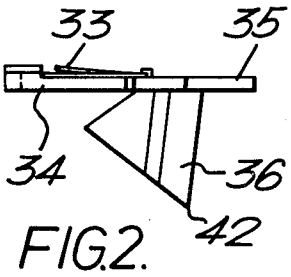
FIG. 2 is a side elevation of a drawer member forming part of the unit shown in FIG. 1.

Referring to FIG. 1, there is shown a switch unit 1 for a thermally controlled electric immersion heater of a kettle, mounted on a kettle wall 2 on one side of an aperture 3 and an immersion heater unit 4 mounted on the other side of the aperture 3.

The heater unit 4 comprises an element carried by a head plate 5, the hot return 6 of the element being brazed to the head plate 5.

The switch unit 1 comprises a body made of a glass fibre reinforced plastics material comprising a chassis plate 7. A cover 8 is secured to the chassis plate 7 and defines therewith a housing. The cover has a recess 9 therein for receiving a mains socket connector 10 for connecting with terminal pins of the switch unit extending into the recess 9. The chassis plate 7 further has apertures therein through which pass in use studs mounted on the head plate 5 of the heater unit, whereby the switch unit may be bolted to the head plate. A resilient sealing ring 11 is arranged in the aperture 3 between a projecting annular rim 12 formed on the chassis plate 7 and the head plate 5.

The tongue 13 of a thermally responsive bimetallic actuator 32 is mounted on a pillar 14 formed on the chassis plate 7.

Figure 3:
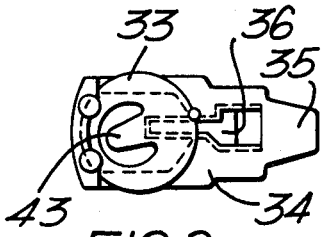
FIG. 3 is a plan view of the member shown in FIG. 2.

The bimetallic actuator 32 is of the type hereinbefore described and disclosed in German Offenlegungschrift No. 2,556,062 and British Patent No. 1,542,252. A second similar actuator 33 is shown in FIG. 3.

The tongue is riveted to the pillar 14, and a small aperture in the tongue is pressed over a pin projecting from the end of the pillar 14 to prevent rotation of the actuator. The actuator is mounted so as to be in contact with the head 5 in the region of the hot return 6 in the cold position of the actuator. The actuator is such that at, say 120° C., at which temperature the element 4 is overheating as a result of a switch on dry condition, the actuator moves with a snap action to its oppositely dished configuration. As this occurs, a push rod 16 extending through and slidable in an aperture in the chassis-plate 7 is displaced by actuator 13 which contacts push rod 16 at its periphery 15 to displace a resilient electrically conductive strip 17.

The strip 17 forms part of the path of electric current from the connector 10 to the element 4. One end of the strip 17 is in contact with a line terminal pin 18. The pin 18 includes ears 19 and extends through an aperture in a pillar 20 of chassis plate 7. An apertured brass plate 44 is arranged on the other side of the aperture and the pin is secured to the brass plate 44 by deforming a bifurcated end 45. The strip 17 is thus sandwiched between the ears 19 and the pillar 20. A movable contact 21 is mounted on the strip 17. In the closed position of the switch, the movable contact 21 engages a fixed contact 22 mounted on a conductive strip 23. When the switch unit is assembled with a heater unit on a kettle, the strip 23 makes contact with a cold lead 24 of the element, the cold lead 24 passing through an aperture in the chassis plate 7.

A bell crank lever 25 made of a glass fibre reinforced plastics material is pivotally mounted on the chassis plate by means of a knife edge 26 formed integrally therewith resting in a pair of notches or bearings 27 formed on the chassis plate 7. A C-spring 28 extends between a notch 29 formed in a pillar 31 extending from the chassis plate 7 and a notch 30 formed on the lever 25.

The second similar thermally responsive bimetallic actuator 33 is mounted in a drawer member 34 which slides in two grooves in the body of the switch unit, a tab 35 on the member 34 extending over the fulcrum of the lever 25 to prevent the knife edge 26 being dislodged from the notches 27 into which it is sprung by the C-spring 28. Normally the tab 35 does not make contact with the lever 25.

The member 34 further comprises a cover portion 36 which is triangular in elevation and substantially surrounds the upper arm of the lever 25 which passes through an aperture in the chassis plate. In the fully inserted position of the drawer member 34, a gap remains between the lowermost corner 42 of cover portion 36 and the chassis plate 7. The actuator 33 is arranged in a position in which, when the kettle boils, steam impinges thereon after passing through a vent aperture 37. The steam is prevented from passing through the aperture in the chassis plate through which the lever 25 passes by the cover 36. Steam condensing on the actuator 33 and surrounding portions of the switch unit runs down inside the cover 36 and remains on the kettle side of the chassis plate 7, so that water is prevented from entering the electrics which are all on the other side of the chassis plate. The end 37 of the lever 25 is in contact with the tongue 43 of the bimetallic actuator 33, in the switched on position, the tongue serving as a stop for the lever. The pillar 31 serves as a stop to prevent excessive displacement of the lever distorting the actuator 33. When the kettle boils, steam impinges on the actuator 33 and it reverses its curvature with a snap action, so that the lever passes its position of unstable equilibrium and is driven to the switched off position by the overcentre C-spring 28. In this position, a stop 38 on the lever 25 engages the resilient strip 17 and separates the contacts 21, 22. A tab on the lever 25 engages a lip on a pillar 41 on the chassis plate 7 to limit movement of the lever. The lower end of the lever travels freely within a groove in the pillar 41 which serves to prevent any substantial sideways movement of the lever.

A second stop 39 is also provided on the lever 25. When the contacts 21, 22 are separated by the switch-on dry actuator 32, the resilient strip 17 engages the stop 39 and trips the lever. Then, if the actuator 32 reverses its curvature with cooling of the element head 5, the switch unit remains off. The arrangement is, moreover, "trip free", in that when the actuator 32 is holding the contacts 21, 22 apart by means of the push rod 16 acting on the resilient strip 17, the contacts 21, 22 cannot be closed by manual pressure on the button 40 on the lever 25, in view of a small clearance provided between the stop 39 and the flexible strip 17.

Reference should be made to Specification No. 1,470,367 for details of the structure which is common to the switch unit disclosed in that Specification and the switch unit of the present invention.

I claim:

1. A switch unit for an electric immersion heater for mounting on the wall of a liquid heating vessel, the switch unit including thermally responsive means sensitive to boiling liquid on a body of the switch unit in a position for exposure, in use, to vapour emerging from the vessel, said thermally responsive means comprising a snap-acting bimetallic actuator comprising a member of sheet bimetal having an aperture with an outer perimeter and an inner perimeter defining a tongue free at one end intermediate two lobe portions of said aperture, said inner perimeter and arcuate portions of said outer perimeter smoothly merging at rounded ends of the aperture adjacent the tongue root, the tongue being, at least in part, generally centrally disposed with respect to the member, the member having been deformed in a die pressing operation to conform in shape to a die of domed configuration, said domed area being such as to reverse its curvature with a snap action with change in temperature, and the width of the domed area being greatest in the region of the tongue root, an overcentre spring mechanism coupling said bimetallic actuator to a movable contact of an electrical switch for opening and closing said switch, said overcentre spring mechanism being movable between a first position in which said switch is closed and power can be supplied to the immersion heater and a second position in which said switch is open for interrupting the supply of power to the immersion heater, a lever of the overcentre mechanism being pivotally mounted on said body and a spring of the overcentre mechanism being mounted between fulcrums provided by said lever and said body so that the spring biasses said lever into direct or indirect engagement with said bimetallic actuator in the first position of the overcentre mechanism.

2. A switch unit as claimed in claim 1, wherein the actuator serves as a stop for the lever in the first position of the overcentre mechanism.

3. A switch unit as claimed in claim 1 or 2, further comprising a second snap-acting thermally responsive bimetallic actuator comprising a member of sheet bimetal having an aperture with an outer perimeter and an inner perimeter defining a tongue free at one end intermediate two lobe portions of said aperture, said inner perimeter and arcuate portions of said outer perimeter smoothly merging at rounded ends of the aperture adjacent the tongue root, the tongue being, at least in part, generally centrally disposed with respect to the member, the member having been deformed in a die pressing operation to conform in shape to a die of domed configuration, said domed area being such as to reverse its curvature with a snap action with change in temperature, and the width of the domed area being greatest in the region of the tongue root, mounted on the body of the switch unit so as in use to make direct thermal contact with a head plate of a heater unit, means coupling said second actuator to said movable contact and to said over-centre mechanism whereby operation of said second actuator to open said switch also moves said overcentre mechanism to said second position thus maintaining said switch open, the arrangement being such that movement of said overcentre mechanism to its first position is ineffective to close said switch whilst said second actuator remains operated.

4. A switch unit as claimed in claim 3, wherein the movable contact of the switch is mounted on a resilient strip, which strip when displaced by operation of said second actuator moves said overcentre mechanism to said second position, but when said overcentre mechanism is moved to said first position, said second actuator holds said contacts open in its hot position.

5. A switch unit as claimed in claim 1 or 2, wherein the body of the switch unit provides a barrier for vapour between said first actuator and said electrical switch and said lever extends through an aperture in said barrier, the unit comprising a cover member partially surrounding the position of said lever on the same side of said barrier as said first actuator so as to reduce penetration of vapour through said aperture.

6. A switch unit as claimed in claim 2, wherein the lever is a bell crank lever which engages the actuator directly in the first position of the overcentre mechanism.

7. A switch unit as claimed in claim 1, wherein the lever engages the actuator via a push rod extending through an aperture in the body of the switch unit.

* * * * *